US007546921B2

(12) United States Patent
Evans et al.

(10) Patent No.: US 7,546,921 B2
(45) Date of Patent: Jun. 16, 2009

(54) PACKAGING SYSTEM FOR SHIPPING A PLURALITY OF ITEMS

(75) Inventors: John A. Evans, N. Huntingdon, PA (US); Marty Patrickus, Canonsburg, PA (US); Darcy Meyer, McMurray, PA (US)

(73) Assignee: International Paper Company, Loveland, OH (US)

( * ) Notice: Subject to any disclaimer, the term of this patent is extended or adjusted under 35 U.S.C. 154(b) by 153 days.

(21) Appl. No.: 11/731,615

(22) Filed: Mar. 30, 2007

(65) Prior Publication Data

US 2008/0017650 A1 Jan. 24, 2008

Related U.S. Application Data

(63) Continuation of application No. PCT/US2005/036120, filed on Oct. 3, 2005.

(60) Provisional application No. 60/615,556, filed on Oct. 1, 2004.

(51) Int. Cl.
*B65D 85/00* (2006.01)

(52) U.S. Cl. ..... 206/394; 206/391; 206/392; 206/395; 206/509; 206/393; 220/507; 220/512; 229/120.06

(58) Field of Classification Search ..... 206/391, 206/394, 509, 499, 392, 395, 393, 396, 413; 220/507, 512, 510, 529; 229/120.04, 120.06, 229/120.24, 120.26; 242/160.2
See application file for complete search history.

(56) References Cited

U.S. PATENT DOCUMENTS 1,054,035 A * 2/1913 Ruhnau ..... 220/512
1,421,099 A * 6/1922 Reed ..... 242/129.6
2,226,603 A * 12/1940 Gagen ..... 229/103.2
2,453,614 A * 11/1948 Belsinger ..... 229/122
2,564,948 A * 8/1951 Beck, Jr. et al. ..... 206/392
2,570,340 A * 10/1951 George ..... 206/392
2,588,791 A * 3/1952 Andrew, Jr. ..... 206/392
2,662,638 A * 12/1953 Storer et al. ..... 206/386
2,699,866 A * 1/1955 Russell, Jr. ..... 206/392
2,706,593 A * 4/1955 Caraher ..... 206/392
2,764,285 A * 9/1956 Prossen ..... 206/392
2,818,974 A * 1/1958 Talbot ..... 206/392
2,860,825 A * 11/1958 Montgomery et al. .. 229/120.29
2,938,625 A * 5/1960 Browning et al. ..... 206/392
3,109,540 A * 11/1963 Klimpl ..... 242/129
3,172,534 A * 3/1965 Martin ..... 206/392
3,227,272 A * 1/1966 Critzer ..... 206/392
3,392,827 A * 7/1968 Bogren ..... 206/392
3,407,758 A * 10/1968 Simkins ..... 108/51.3
3,621,995 A * 11/1971 Francis ..... 206/392
3,804,234 A * 4/1974 Gordon ..... 206/392
4,142,634 A * 3/1979 Leff et al. ..... 206/392

(Continued)

FOREIGN PATENT DOCUMENTS

CH 162984 9/1933

*Primary Examiner*—Anthony D Stashick
*Assistant Examiner*—Christopher B McKinley
(74) *Attorney, Agent, or Firm*—Thomas W. Ryan, III

(57) ABSTRACT

The present invention relates generally to a container for shipping, storing and handling a plurality of items. More particularly, the present invention relates to a container for shipping, storing and handling a plurality of items, wherein the items are held securely in place so as to prevent damage thereto during transportation.

22 Claims, 10 Drawing Sheets

U.S. PATENT DOCUMENTS 4,516,677 A * 5/1985 Rowland et al. ..... 206/394
4,595,093 A * 6/1986 Eckstein ..... 206/771
4,821,880 A * 4/1989 Ditton ..... 206/386
4,998,619 A * 3/1991 Sowa et al. ..... 206/392
5,161,703 A * 11/1992 Patton ..... 211/59.4
5,390,789 A * 2/1995 Darby ..... 206/391
5,551,563 A * 9/1996 Allen ..... 206/394
5,624,031 A * 4/1997 Fowler et al. ..... 206/391
5,758,771 A * 6/1998 Rose ..... 206/386
5,826,742 A * 10/1998 Timpert ..... 220/23.6
5,924,569 A 7/1999 Kleinschmit et al.
5,960,954 A * 10/1999 Seybold ..... 206/389
6,047,523 A * 4/2000 Eyre et al. ..... 53/399
6,899,225 B2 * 5/2005 Shuert ..... 206/392
2004/0149611 A1 * 8/2004 Shuert ..... 206/394

* cited by examiner

PACKAGING SYSTEM FOR SHIPPING A PLURALITY OF ITEMS

TECHNICAL FIELD

The present invention relates generally to a container for shipping, storing and handling a plurality of items. More particularly, the present invention relates to a container for shipping, storing and handling a plurality of items, wherein the items are held securely in place so as to prevent damage thereto during transportation.

BACKGROUND ART

In the manufacturing, shipping, storing, handling and use of textiles and other fiber, strand, tape, strip, web or sheet materials, it is customary for such materials to be wound on cylindrical (or conical) cores and shipped as spools of material. A typical spool has a cylindrical configuration and may be sized up to twelve inches in diameter and between six and twelve inches in width.

For shipping and/or delivery of the material to an end-user thereof, a plurality of spools are arranged in side-by-side fashion on a tray or pallet constructed from corrugated material. Two or more trays are arranged in a stacked configuration and shrink-wrapped (or otherwise bundled), thereby defining a bundled package of a plurality of spools of material. It is desirable, therefore, to provide a packaging system for shipping and/or delivering a plurality of items arranged in a side-by-side and stacked configuration.

Conventional shipping packaging systems do not adequately prevent the spools from coming into contact with one another during shipping. Such contact may result in damage to the material, thereby rendering some or all of the material wound on the damaged spools as unusable. It is therefore desirable to provide a packaging system for shipping and/or delivering a plurality of items arranged in a side-by-side and stacked configuration such that the plurality of items are held securely in such configuration so as to minimize the likelihood that two or more of the items will come into contact with one another during shipping.

It is customary for the end-user of the material to store the spools of material in the packages used to deliver them and to remove the spools from their respective packages on an as-needed basis. It is desirable, therefore to provide a packaging system that is adapted to be used as storage for the spools of material until such time as the spools are needed. For example, it is desirable for the packages to themselves be stackable such that two or more of the packages may be placed in a stacked configuration for storage of a very large number of spools of material.

SUMMARY OF THE INVENTION

The present invention provides a packaging system for shipping, storing and handling a plurality of items, such as spools of textile or other fiber, strand, tape, strip, web or sheet material wound onto a core. The packaging system according to a preferred embodiment of the present invention is adapted to arrange a plurality of items in a side-by-side stacked configuration such that the items are positioned securely during shipping so as to minimize the risk of damage thereto during transit.

According to one aspect of the present invention, a packaging system of the present invention provides a bottom cap, a top cap and a plurality of trays for arranging the plurality of items in a side-by-side stacked configuration. The caps and the trays each are constructed from foldable corrugated material. A top sheet and/or bottom sheet may be placed within the top cap and/or bottom cap, respectively, for the purpose of securely positioning the spools, relative to the caps.

Each of the trays includes three flaps arranged in an end-to-end configuration such that outboard flaps each are foldable over the center flap, thereby defining a three-ply construction for use as a tray. Furthermore, each flap includes a pattern of holes which are in patterned alignment when the outboard flaps are folded over the center flap. According to one aspect of the present invention, the holes of one of the flaps are of a diameter which is less than a diameter of the holes of one of the outboard flaps, thereby defining an annular lip upon which a core portion of one of the items is allowed to rest.

According to another aspect of the present invention, the holes of at least one of the flaps is sized and configured to frictionally grip the core portion of one of the

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

BEST MODES FOR CARRYING OUT THE INVENTION

Figure 1:
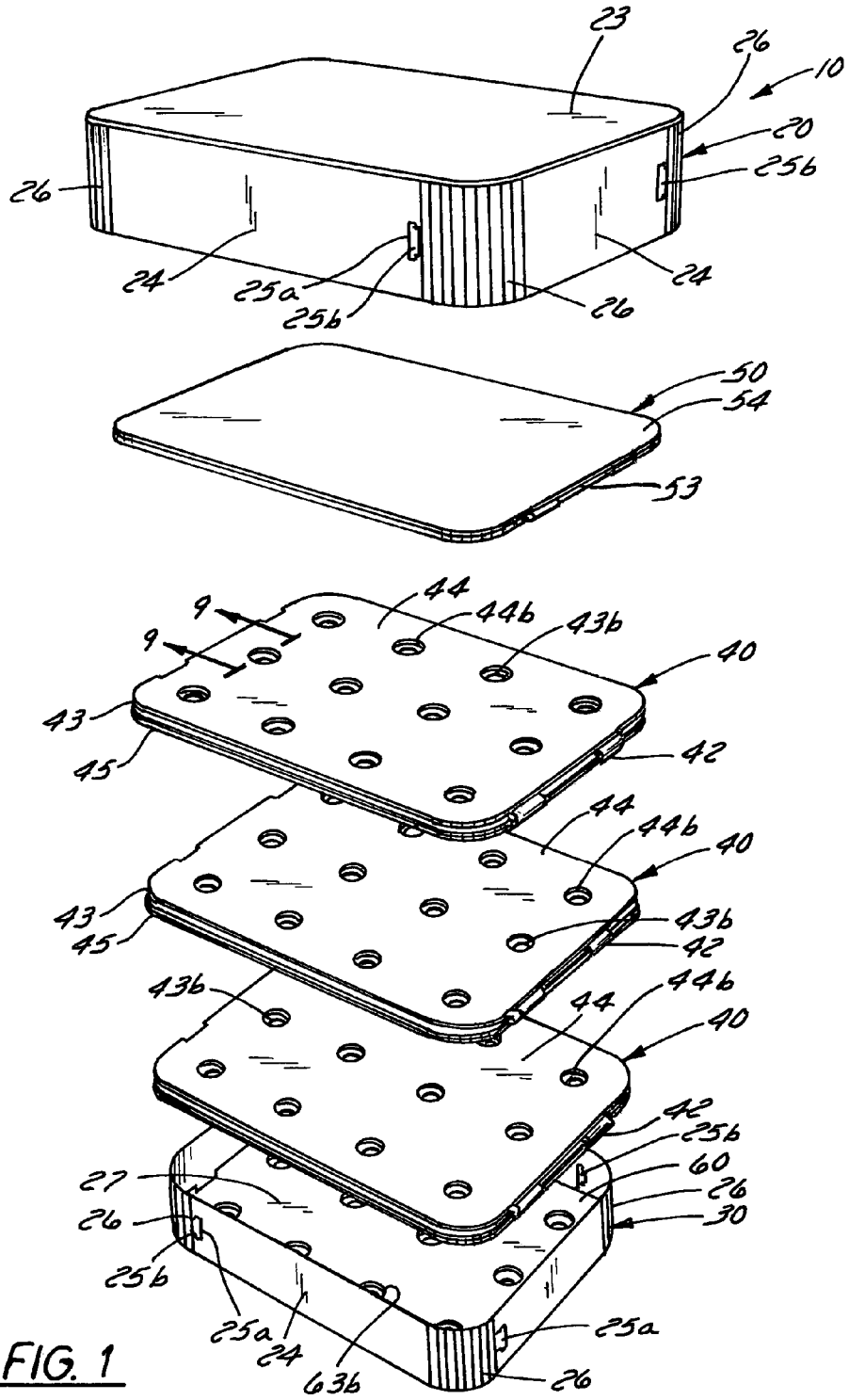
FIG. 1 is an exploded perspective view of the packaging system according to a preferred embodiment of the present invention.

With reference to FIG. 1, a packaging system 10 according to a preferred embodiment of the present invention includes a top cap 20, a bottom cap 30, one or more trays 40, an upper slipsheet 50 and a lower slipsheet 60, all of which are constructed, respectively, preferably from sheets of multi-ply corrugated kraft paperboard. The sheets of paperboard preferably are die-cut into the foldable blanks, each of which is folded to form the components described in greater detail below.

Figure 2:
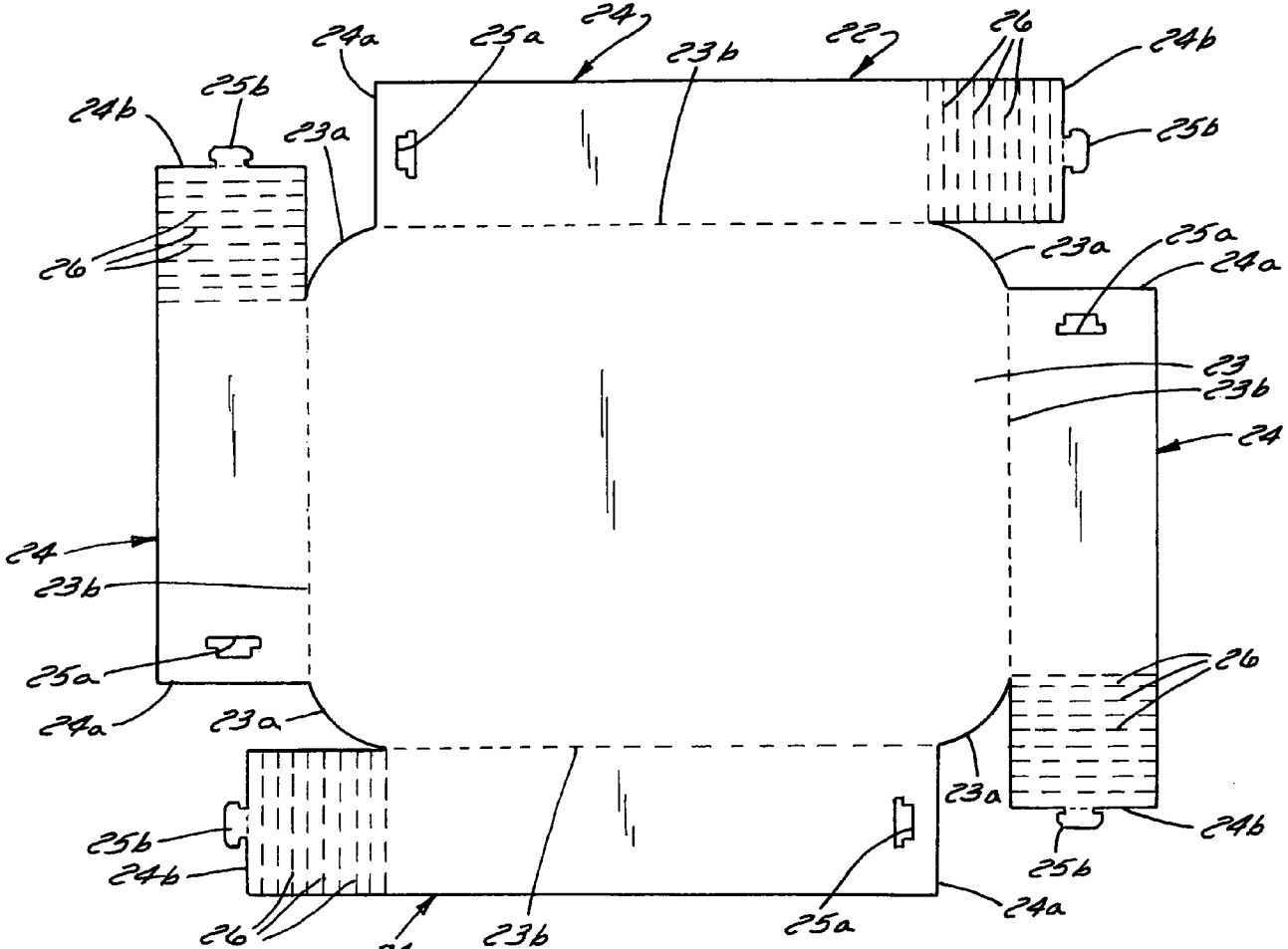
FIG. 2 is a top view of a die-cut blank used to form the top and bottom caps of the packaging system shown in FIG. 1.

With additional reference to FIG. 2, the top cap 20 and the bottom cap 30 each may be formed from an identical blank 22 constructed from conventional corrugated kraft paperboard. The blank 22 includes a generally rectangular center panel 23 having rounded corners 23*a* and first, second, third and fourth sidewall panels 24, each sidewall panel 24 extending from one sidewall edge 23*b* of the center panel 23. Sidewalls 24 and center panel 23 are continuous along sidewall edges 23*b* such that sidewall edges 23*b* coincide with and define foldlines in the blank 22 for folding the sidewall panels 24 relative to the center panel 23.

Each sidewall panel 24 includes a first end 24*a* and a second end 24*b*. A tab-receiving opening 25 is provided near the first end 24*a* of each sidewall panel 24 and a tab 25*b* extends from (or is otherwise provided by) the second end 24*b* of each sidewall panel 24. A plurality of parallel, transverse foldlines 26 extend substantially the width of each sidewall panel 24 near the second end 24*b* thereof, respectively.

Top cap 20 and bottom cap 30 each are formed by folding each sidewall panel 24 about its respective edge/foldline 23*b* such that the sidewall panels 24 each are oriented generally perpendicular to the center panel 23. The second end 24*b* of each sidewall panel 24 is then folded along its respective center panel corner 23*a*, wherein the foldlines 26 of each sidewall panel 24 facilitate the sidewall panel 24 assuming a generally curvilinear shape near the second end 24*b* thereof. The tab 25*b* of each sidewall panel 24 is thereafter inserted into the tab-receiving opening 25*a* of the next-adjacent sidewall panel 24 and locked thereinto by any conventional means. Alternatively, the tab 25*b* or another portion near the second end 24*b* of each sidewall panel 24 may be affixed to a portion near the first end 24*a* of the next-adjacent sidewall panel 24, such as by adhesive, tape, staples, or the like.

It will be apparent to those of ordinary skill in the art that top cap 20 and bottom cap 30 are merely arranged in face-to-face orientation with respect to one another to define top and bottom extremities of the packaging system 10 according to a preferred embodiment of the present invention. Sidewall panels 24 cooperate with center panel 23 to define an interior region 27 of the top cap 20 and bottom cap 30, respectively. Bottom cap 30, in particular, is sized to be situated upon a conventional wood pallet 70 (FIG. 6), or corrugated pallet (FIG. 6) and may be affixed thereto by any conventional means.

Figure 3:
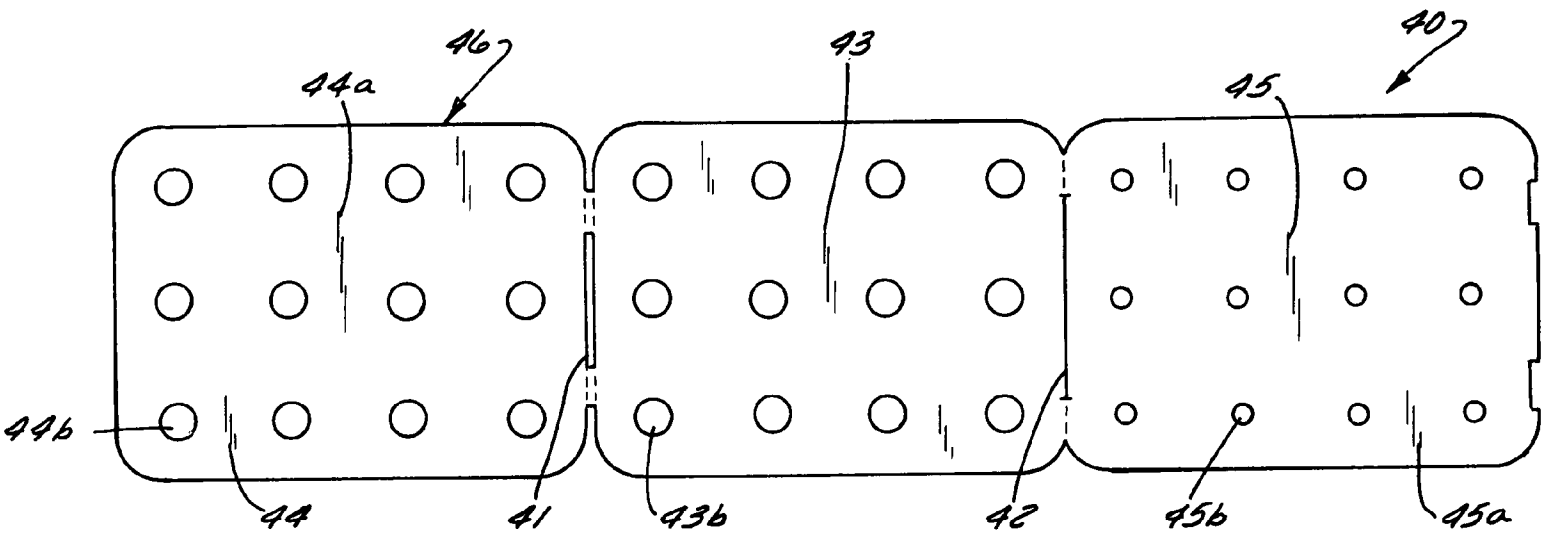
FIG. 3 is a top view of a die-cut blank used to form the first, second and third trays of the packaging system shown in FIG. 1.

With reference now to FIG. 3, a blank 46 is shown for forming one or more trays 40 used to arrange a plurality of items 80 (FIG. 6), such as spools, thereupon. The blank 46 is constructed from a die-cut sheet of conventional multi-ply corrugated kraft paperboard and is foldable as described in greater detail below. Preferably, the blank 46 is of a generally elongated rectangular shape divided by two generally parallel fold regions 41, 42 into a center panel 43, a first outboard panel 44 and a second outboard panel 45. According to one aspect of the present invention, the first fold region 41 is in the form of a thin bridge element connecting the first outboard panel 44 to the center panel 43, wherein the thin bridge element acts to space the first outboard panel 44 from the center panel 43. The second fold region 42 is in the form of a simple foldline connecting the second outboard panel 45 and another end of the center panel 43. It will be apparent to those of ordinary skill in the art that center panel 43, first outboard panel 44 and second outboard panel 45 are continuous and form an end-to-end configuration.

Tray 40 is constructed by first folding the second outboard flap 45 about the second fold region 42 over an upper face 43*a* of the center panel 43 such that, when folded, a first face 45*a* of the second outboard panel 45 faces the upper face 43*a* of the center panel 43. The first outboard panel 44 is thereafter folded about the first fold region 41 over the second outboard panel 45 (which has been folded over the center panel 43 as described above) such that a first face 44*a* of the first outboard panel 44 faces a second face (not shown) of the second outboard panel 45. It will be apparent to one of ordinary skill in the art that the first fold region 41 spaces the first outboard panel 44 from the center panel 43 so that the first outboard panel 43 is permitted to fold over the second outboard panel 45 and to sandwich the second outboard panel 45 between the center panel 43 and the first outboard panel 44. It will also be apparent to one of ordinary skill in the art that other foldable configurations may be employed while still keeping within the spirit and the scope of the present invention.

Center panel 43 includes one or more openings 43*b* arranged thereon to define a pattern, such as, for example, a matrix spaced evenly thereover. First outboard panel 44 includes one or more openings 44*b* arranged thereon to define a pattern, such as, for example, a matrix spaced evenly thereover. Openings 43*b*, 44*b* may be in the form of circular die-cutouts, although some or all of the openings 43*b*, 44*b* may be formed with a non-circular shape, such as, for example, an octagonal shape with rounded corners and arched sides. It is not necessary for all openings 43*b*, 44*b* to have the same shape, and openings 43*b* of the center panel 43 may have a shape that is different from the shape of the openings 44*b* of the first outboard panel 44. Alternatively, openings 43*b*, 44*b* need not be cutouts provided through the entire thickness of the center panel 43 and first outboard panel 44, respectively; rather, center panel 43 and first outboard panel 44 may be crushed or otherwise compressed so as to provide a region resembling an opening, the function of which will become apparent to those of ordinary skill in the art upon reading the following description.

Figure 9:
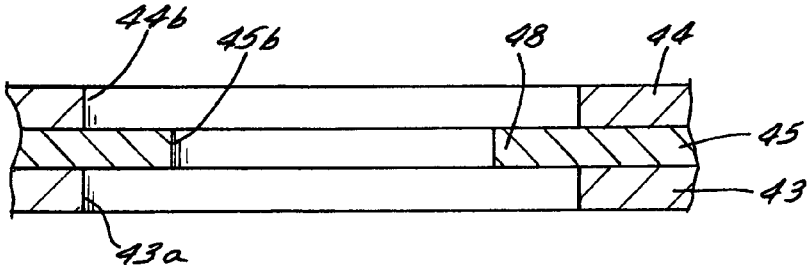
FIG. 9 is a partial cross-sectional view of the tray shown in FIG. 1, taken along section line 9-9 of FIG. 1; and, FIG. 10 is a partial cross-sectional view of the tray shown in FIG. 6, taken along section line 10-10 of FIG. 6.

Second outboard panel 45 (which is positioned between the center panel 43 and the first outboard panel 44 when the blank 40 is folded as described above) includes one or more holes 45*b* arranged thereon to define a pattern, such as, for example, a matrix spaced evenly thereover. Holes 45*b* may be shaped in the same manner as openings 43*b*, 44*b*. Holes 45*b* are arranged on the second outboard panel 45 such that holes 45*b* are aligned with one or more openings 43*b* of the center panel 43 and are aligned with one or more openings 44*b* of the first outboard panel 44. Although holes 45*b* may have a shape which resembles openings 43*b*, 44*b*, it is preferable for holes 45*b* to be dimensioned less than openings 43*b*, 44*b*. Referring back to FIG. 1 and to FIG. 9, it can be seen that such relative dimensioning will define an annular ledge 48 positioned between openings 43*b*, 44*b* when the panels 43, 44, 45 are folded as described above. The function of this annular ledge 48 will be described in greater detail below.

Figure 4:
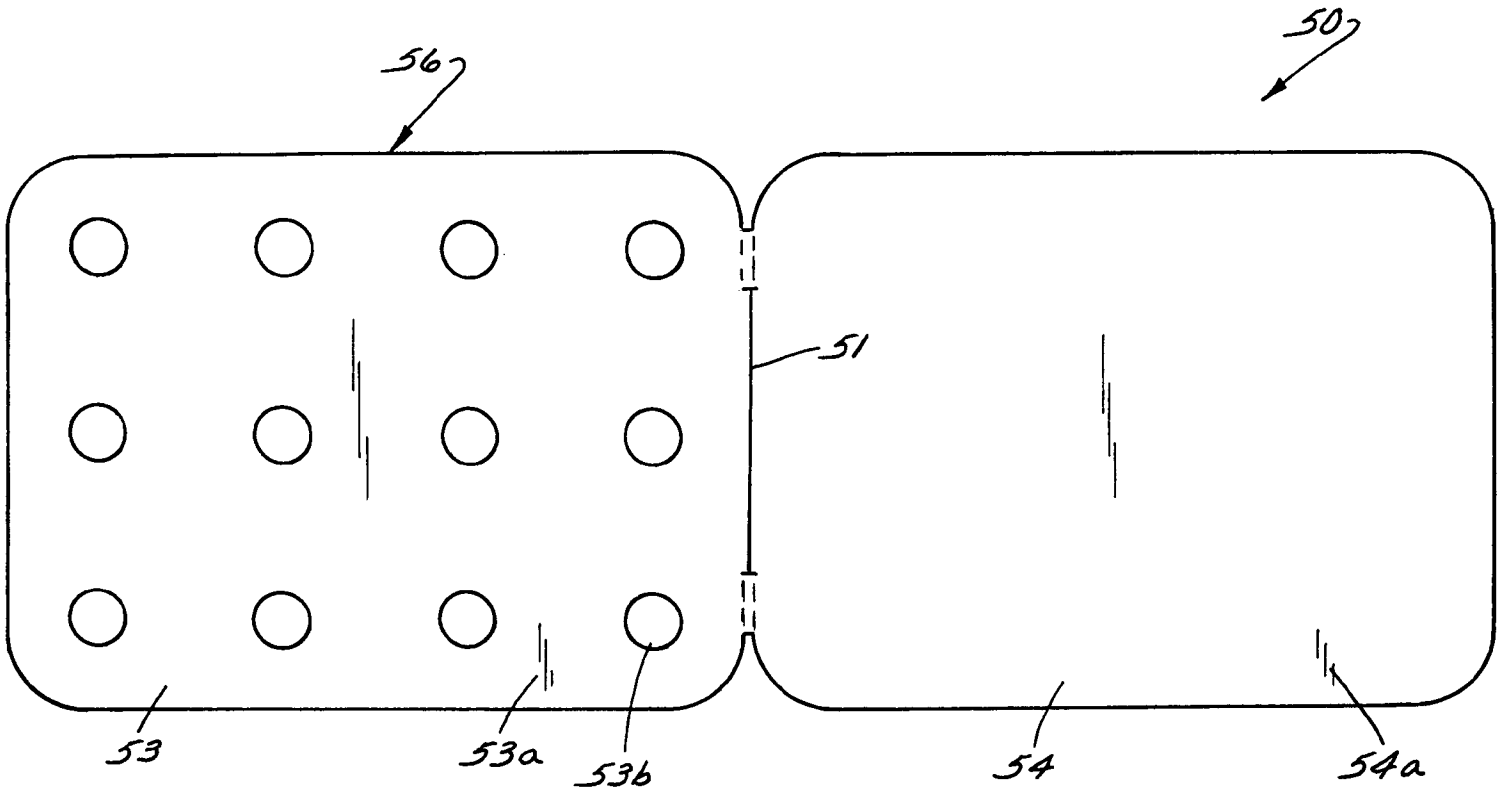
FIG. 4 is a top view of a die-cut blank used to form the upper slipsheet of the packaging system shown in FIG. 1.

Referring now to FIG. 4, a blank 56 is shown for forming the upper slipsheet 50. The blank 56 is constructed from a die-cut sheet of conventional multi-ply corrugated kraft paperboard and is foldable as described in greater detail below. Preferably, the blank 56 is of a generally elongated rectangular shape divided by foldline 51 into a first panel 53 and a second panel 54 which are continuous with one another and form an end-to-end configuration.

Upper slipsheet 50 is constructed by folding the second flap 54 about the foldline 51 over an upper face 53*a* of the first panel 53 such that, when folded, a first face 54*a* of the second panel 54 faces the upper face 53*a* of the first panel 53. Upper slipsheet 50 is sized to fit within the interior region of the top cap 20 or bottom cap 30.

First panel 53 includes one or more openings 53*b* arranged thereon to define a pattern, such as, for example, a matrix spaced evenly thereover. Openings 53*b* may be in the form of circular die-cutouts, although some or all of the openings 53*b* may be formed with a non-circular shape, such as, for example, an octagonal shape with rounded corners and arched sides. It is not necessary for all openings 53*b* to have the same shape and openings 53*b* need not be cutouts provided through the entire thickness of the first panel 53; rather, first panel 53 may be crushed or otherwise compressed so as to provide a region resembling an opening, the function of which will become apparent to those of ordinary skill in the art upon reading the following description.

Figure 5:
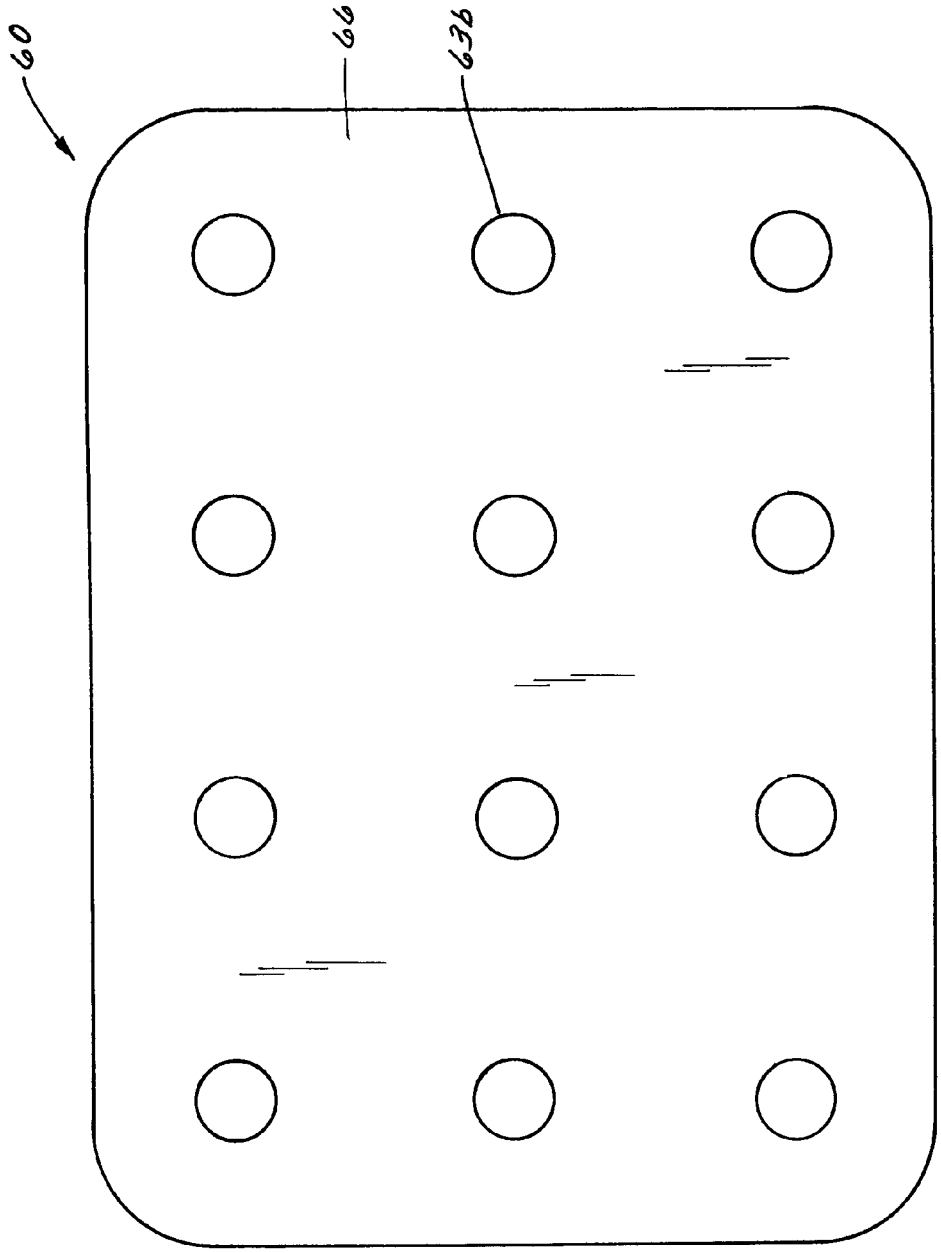
FIG. 5 is a top view of a die-cut blank used to form the lower slipsheet of the packaging system shown in FIG. 1.

With reference to FIG. 5, a blank 66 is shown for forming the lower slipsheet 60. The blank 66 is constructed from a die-cut sheet of conventional multi-ply corrugated kraft paperboard and is of a generally elongated rectangular shape. Lower slipsheet 60 is sized to fit within the interior region of the bottom cap 30 or top cap 20.

Lower slipsheet 60 includes one or more openings 63*b* arranged thereon to define a pattern, such as, for example, a matrix spaced evenly thereover. Openings 63*b* may be in the form of circular die-cutouts, although some or all of the openings 63*b* may be formed with a non-circular shape, such as, for example, an octagonal shape with rounded corners and arched sides. It is not necessary for all openings 63*b* to have the same shape and openings 63*b* need not be cutouts provided through the entire thickness of the lower slipsheet 60; rather, lower slipsheet 60 may be crushed or otherwise compressed so as to provide a region resembling an opening, the function of which will become apparent to those of ordinary skill in the art upon reading the following description.

Figure 6:
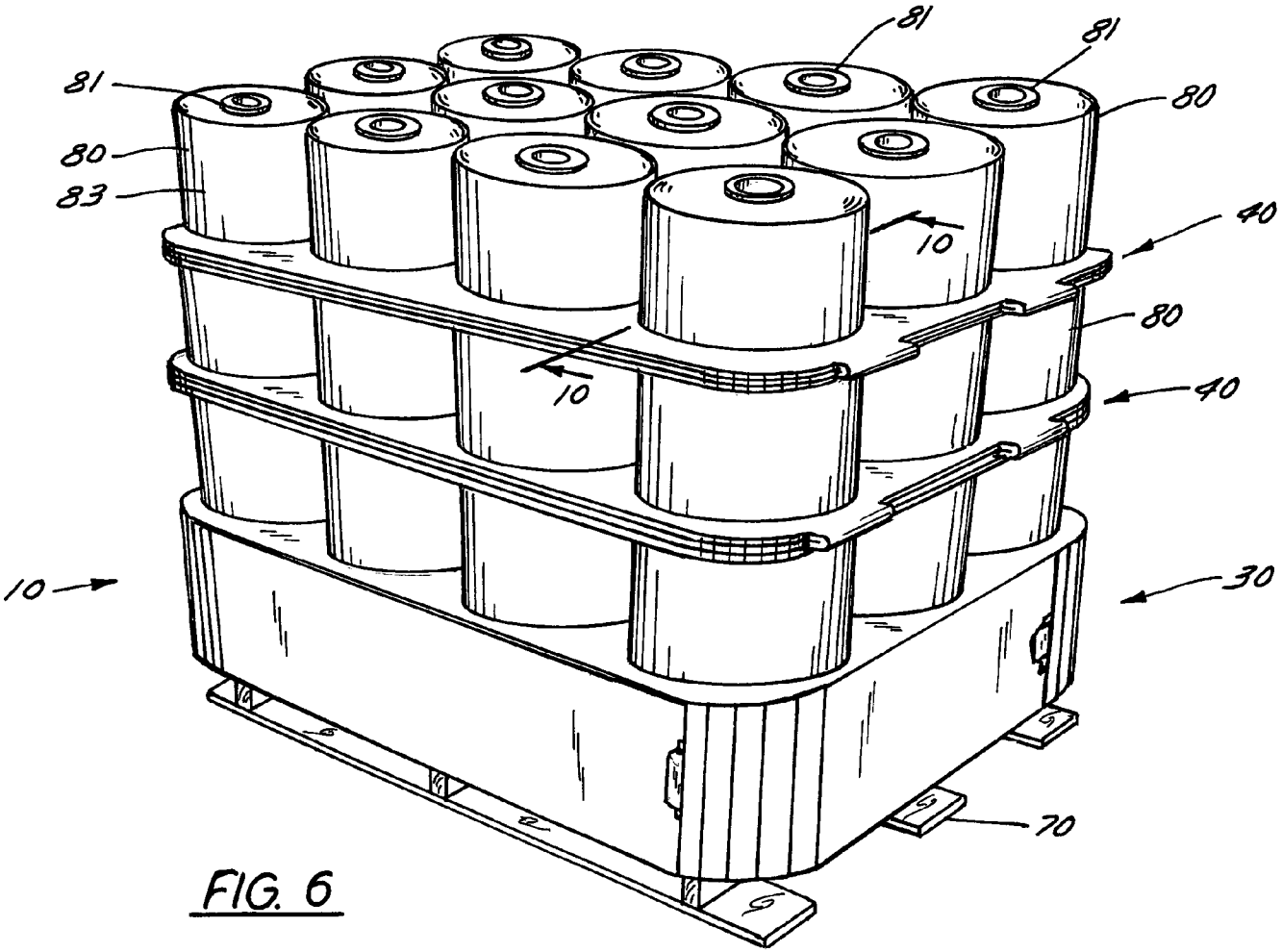
FIG. 6 is a photograph of a portion of the packaging system shown in FIG. 1 showing four trays of items arranged in a stacked configuration.

With reference to FIG. 6, assembly of the packaging system 10 according to a preferred embodiment of the present invention will be described. The packaging system 10 is useful to ship, store and handle a plurality of items 80 (such as a spool of material as described in greater detail above) arranged in a side-by-side, stacked orientation. For the purpose of illustration only, items 80 adapted for use with the packaging system 10 according to the present invention will be described and typically include a cylindrical core 81 and a strand material wound around the core 81 to form a body 83. The core 81 typically is between 2 and 4 inches in diameter and between 6 and 8 inches in length. The body 83 typically is between 8 and 12 inches in diameter and between 6 and 10 inches in width. Distal ends of the core 81 typically protrude from opposing side faces of the body 83 by a distance of between 1 and 3 inches.

A conventional pallet 70 constructed from wood or laminated corrugated material is provided with sufficient size to arrange a plurality of items 80 in side-by-side arrangement thereon. For example, the pallet may be approximately 4 feet long and 3 feet wide so as to permit 12 items 80 to be arranged thereon in a 3×4 matrix, as shown. The bottom cap 30 is positioned on the pallet 70 and may be secured thereto, such as, for example, by adhesive, straps, staples, or any conventional attachment means. Referring now also to FIG. 1, the lower slipsheet 60 is positioned within the interior space of the bottom cap 30. Alternatively, a slipsheet (not shown) resembling the upper slipsheet 50 or tray 40 may be positioned within the bottom cap 30 instead of the lower slipsheet 60, thereby reducing the total number of unique components used to construct the packaging system of the present invention.

A lower end of the core 81 of each item 80 is insertable into one of the plurality of openings 63*b* provided in the lower slipsheet 60 such that the lower end of the core 81 is frictionally gripped by the lower slipsheet 60. That is, each opening 63*b* has a diameter that is smaller than an outer diameter of the core 81, thereby defining a frictional interference fit therebetween when the lower end of the core 81 is inserted into one of the openings 63*b*. The items 80, therefore, are held at their lower ends, relative to one another, by the lower slipsheet 60. The bottom cap 30 is of a height so as to encircle the plurality of items 80 arranged therewithin.

A tray 40, having first been folded as described above, is placed on top of the plurality of items 80 so that an upper end of the core 81 of each item 80 is aligned with and received by one of the plurality of openings 43*b* provided in the center panel 43 of the tray 40, which has been folded and positioned so as to place the center panel 43 of the tray 40 in a downwardly-facing orientation. The upper end of the core 81 is frictionally gripped by the center panel 43 of the tray 40. That is, each opening 43*b* has a diameter that is smaller than an outer diameter of the upper end of the core 81, thereby defining a frictional interference fit therebetween when the upper end of the core 81 is inserted into one of the openings 43*b*. The items 80, therefore, are held at their upper ends, relative to one another, by the tray 40. The bottom cap 30 is of a height so as to encircle the plurality of items 80 arranged therewithin.

Figure 10:
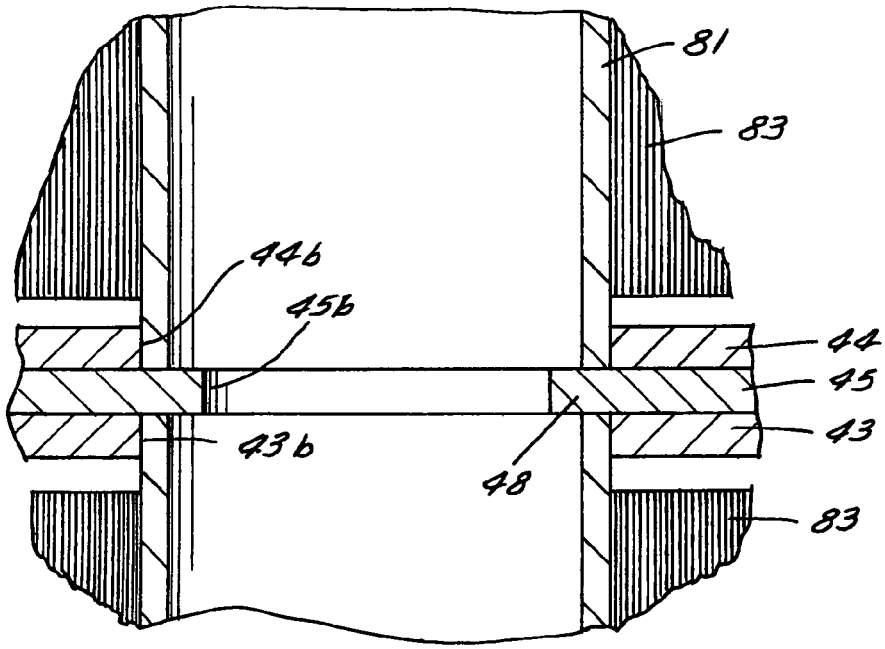

A second tier of items 80 can thereafter be arranged on the tray 40, which has been placed on top of the first tier of items 80, using the openings 44*b* provided in the outboard panel 44 of the tray 40, which has been folded so as to place the first outboard panel 44 in an upwardly-facing orientation. With reference to FIG. 10, the stacked arrangement of the items 80 can be seen, wherein the holes 45*b* of the second outboard panel 40 of the tray 40 (which has been folded so as to position the second outboard panel 45 between the first outboard panel 44 and the center panel 43) each includes a diameter that is less than the diameter of the openings 44*b*, 43*b* of the first outboard panel 44 and the center panel 44, respectively, thereby defining a step 48 upon which items 80 in the second tier can rest. Items 80 in the second tier, then, are supported by the tray 40, rather than by items 80 in the first (lower) tier positioned therebelow.

Figure 7:
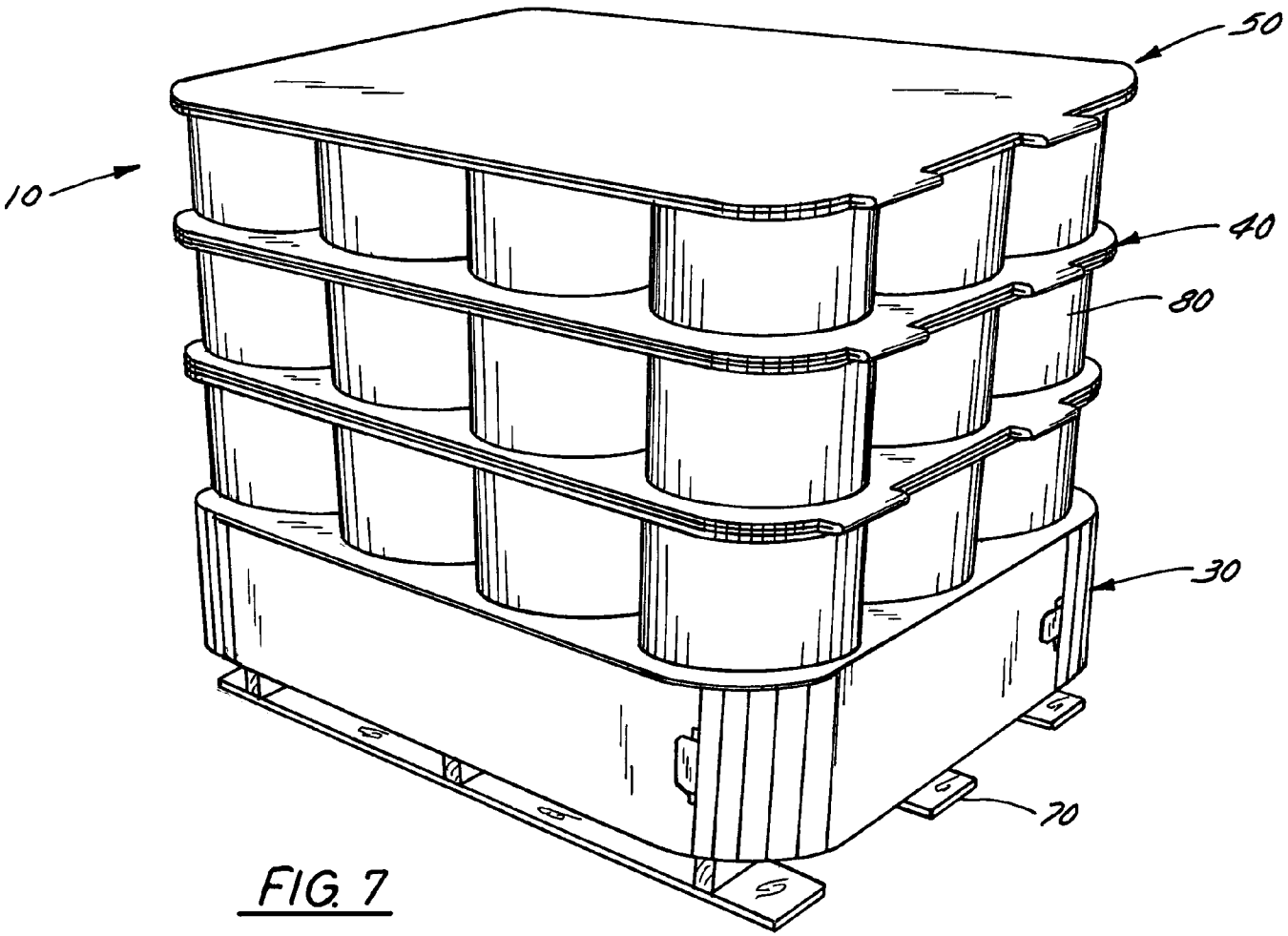
FIG. 7 is a photograph of a portion of the packaging system shown in FIG. 6, further showing a upper slipsheet positioned over the stack of items.

With reference to FIG. 7, one or more additional tiers of items 80 may be stacked upon the first and second tiers in a similar fashion, as shown in the Figures, thereby defining a side-by-side, stacked arrangement of a plurality of items 80. Upper slipsheet 50 is folded as described above and positioned such that the first flap 53 is in a downwardly-facing orientation, whereby the openings 53*b* of the upper slipsheet 50 are aligned with the top ends of the cores 81 such that the top ends of the cores 81 are received by the openings 53*b*, thereby securing the items 80 in the top tier relative to one another. An additional tray 40 may be used instead of upper slipsheet 50.

Figure 8:
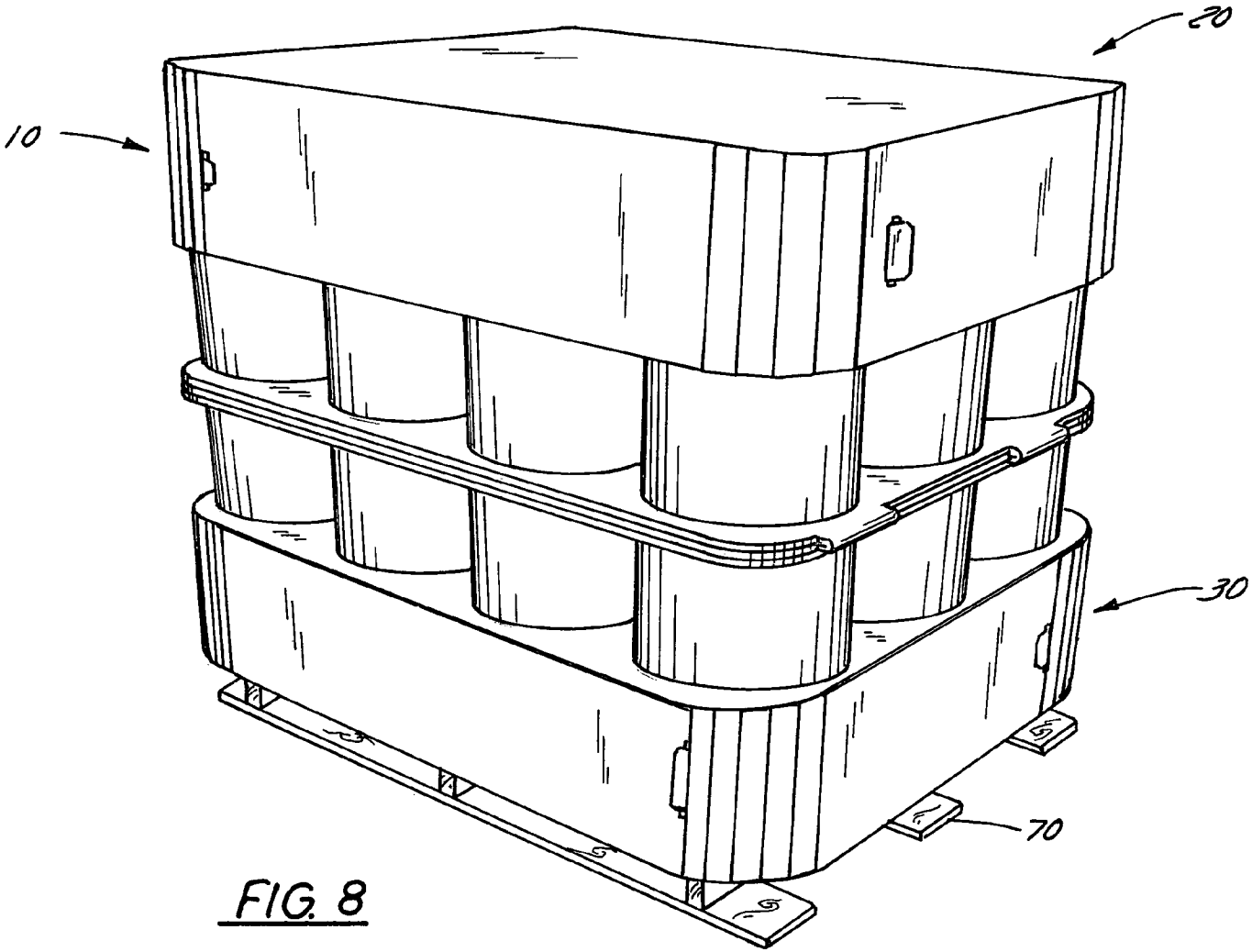
FIG. 8 is a photograph of a portion of the packaging system shown in FIG. 6, further showing a top cap positioned over the stack of items.

With reference to FIG. 8, the top cap 20 is positioned over the top tier of items 80, thereby securing same. Poly wrap may be used to wrap the entire packaging system 10.

While the invention has been described with reference to preferred embodiments, those skilled in the art will appreciate that certain substitutions, alterations and omissions may be made without departing from the spirit thereof. Accordingly, the foregoing description is meant to be exemplary only and should not be deemed limitative on the scope of the invention set forth in the following claims.

The invention claimed is:

1. A packaging system, comprising a bottom cap constructed from foldable corrugated material;

a top cap constructed from foldable corrugated material;

a plurality of trays wherein each tray is constructed from foldable corrugated material and comprises at least two outboard flaps and a center flap arranged in an end-to-end configuration such that outboard flaps each are foldable over the center flap, thereby defining a three-ply construction for use as a tray; and at least one of a top sheet, bottom sheet, or both wherein the top sheet or bottom sheet or both are contained within the top cap or bottom cap or both, wherein each flap includes a pattern of holes which are in patterned alignment when the outboard flaps are folded over the center flap and the holes of at least one flap are of a diameter which is less than a diameter of the holes on one of the outboard flaps so as to define an annular lip.

2. The packaging system according to claim 1, wherein the at least two outboard flaps and the center flap of at least one tray are foldably connected.

3. The packaging system according to claim 1, wherein the system contains at least one top sheet contained within the top cap and at least one bottom sheet contained within the bottom cap.

4. The packaging system according to claim 1, wherein the top cap, bottom cap, or both comprise a plurality of side walls formed from a plurality of side wall panels.

5. The packaging system according to claim 4, wherein the top cap, bottom cap, or both comprise at least four side walls.

6. The packaging system according to claim 1, wherein the top cap, bottom cap, or both comprise a center panel.

7. The packaging system according to claim 6, wherein the top cap, bottom cap, or both comprise a center panel having a plurality of center panel corners.

8. The packaging system according to claim 7, wherein at least one of the center panel corners has a curvilinear shape.

9. The packaging system according to claim 1, wherein the top cap, bottom cap, or both comprise a plurality of side walls having opposite ends; and a center panel having a plurality of center panel corners, wherein at least one of the center panel corners has a curvilinear shape; and at least of the opposite ends of at least one of the side walls has a curvilinear shape.

10. The packaging system according to claim 9, wherein at least one of the center panel corners having a curvilinear shape and at least of the opposite ends of at least one of the side walls having a curvilinear shape are positioned adjacent to one another to define a curvilinear corner of the top cap, bottom cap, or both.

11. The packaging system according to claim 1, wherein the top cap, bottom cap, or both comprise a plurality of side walls having opposite ends, wherein a first opposite end contains a tab and a second opposite end contains a tab-receiving opening positioned such that the side walls are locked into an erected position by inserting the tab of a first side wall into the tab-receiving opening of an adjacent second side wall.

12. The packaging system according to claim 1, wherein the top cap, bottom cap, or both comprise a plurality of side walls, wherein a portion of a first side wall is affixed to a portion of a second side wall.

13. The packaging system according to claim 12, wherein a portion of a first side wall is affixed to a portion of a second side wall by at least one member selected from the group consisting of tape, adhesive, and staple.

14. The packaging system according to claim 1, wherein at least one tray comprises at least one of the outboard flaps foldably connected to the center flap along a thin bridge element such that the thin bridge element spaces an edge of the at least one outboard flap from an edge of the center flap.

15. The packaging system according to claim 1, wherein at least one tray comprises at least one of the outboard flaps foldably connected to the center flap along a fold line.

16. The packaging system according to claim 1, wherein at least one tray comprises at least two outboard flaps and a center flap arranged such that, when folded, a face of at least one second outboard flap is positioned between a face of the center flap and a face of at least one first outboard flap.

17. The packaging system according to claim 16, wherein the at least one first outboard flap is foldably connected to the center panel by a thin bridge element such that, when folded, the at least one first outboard panel is spaced from the center panel.

18. The packaging system according to claim 1, wherein at least one tray has at least one corner that is curvilinear.

19. The packaging system according to claim 1, wherein at least one flap contains at least one selected from the group of circular holes, non-circular holes, rounded holes, octagonal holes, octagonal holes with rounded corners, and octagonal holes with arched sides.

20. The packaging system according to claim 1, wherein the top sheet, bottom sheet, or both contain a pattern of holes.

21. The packaging system according to claim 20, wherein the pattern of holes of the top sheet, bottom sheet, or both matches the pattern of holes of a tray adjacent thereto.

22. The packaging system according to claim 21, wherein the top sheet, bottom sheet, or both contain at least one selected from the group of circular, non-circular, rounded, octagonal holes, octagonal holes with rounded corners, and octagonal holes with arched sides.

* * * * *